US006045374A

United States Patent [19]

Candeloro

[11] Patent Number: 6,045,374

[45] Date of Patent: Apr. 4, 2000

[54] ELECTRICAL WIRING SYSTEM

[76] Inventor: Salvatore Candeloro, 20 Fortune La., Apt. 2, Rochester, N.Y. 14626-1838

[21] Appl. No.: 09/049,401

[22] Filed: Mar. 27, 1998

Related U.S. Application Data

[63] Continuation-in-part of application No. 08/692,764, Aug. 6, 1996, Pat. No. 5,762,525.

[51] Int. Cl.[7] ..... H01R 4/66

[52] U.S. Cl. ..... 439/105; 439/925; 439/654; 439/650; 439/652; 439/535

[58] Field of Search ..... 439/105, 107, 439/209, 210, 211, 215, 925, 535, 650, 654, 652

[56] References Cited

U.S. PATENT DOCUMENTS

| | | | |
|---|---|---|---|
| 3,061,716 | 10/1962 | Benander | 439/652 |
| 3,253,085 | 5/1966 | Stern . | |
| 3,715,627 | 2/1973 | D'Ausilio . | |
| 3,997,225 | 12/1976 | Horwinski . | |
| 4,083,617 | 4/1978 | Wyatt . | |
| 4,173,382 | 11/1979 | Booty . | |
| 4,231,630 | 11/1980 | Propst et al. . | |
| 4,239,932 | 12/1980 | Textoris et al. . | |
| 4,270,020 | 5/1981 | Kenworthy et al. . | |
| 4,631,648 | 12/1986 | Nilssen . | |
| 4,740,167 | 4/1988 | Millhimes et al. | 439/654 |
| 4,990,098 | 2/1991 | Neidecker et al. . | |
| 5,094,630 | 3/1992 | Jammet | 439/652 |
| 5,162,614 | 11/1992 | Bogiel et al. . | |
| 5,380,225 | 1/1995 | Inaoko . | |
| 5,433,633 | 7/1995 | Matsumoto et al. . | |
| 5,460,542 | 10/1995 | Castellani et al. | 439/535 |
| 5,572,779 | 11/1996 | Adelman et al. . | |
| 5,584,714 | 12/1996 | Karst et al. | 439/215 |
| 5,584,729 | 12/1996 | Luu | 439/652 |
| 5,593,311 | 1/1997 | Lybrand . | |
| 5,807,141 | 9/1998 | Sexton | 439/535 |

FOREIGN PATENT DOCUMENTS

| | | |
|---|---|---|
| 2 039 421 | 8/1980 | United Kingdom . |

*Primary Examiner*—Paula Bradley
*Assistant Examiner*—Tho D. Ta
*Attorney, Agent, or Firm*—Harter, Secrest & Emery LLP; Stephen B. Salai

[57] ABSTRACT

An electrical wiring connector having a generally rectangular flat base lying in a first plane; a generally rectangular cover matable with the base, the cover having a top and side walls, the base and cover when in mating relation defining an enclosed space; at least two openings in the cover, one opening in each of at least two of the side walls adjacent to the base; a plurality of separate, flat conductive strips carried by the base, each conductive strip having at least two ends, each conductive strip extending along a separate path between each of the at least two openings, each separate path traversing multiple planes; and a plurality of first terminals on respective ends of each conductive strip, each first terminal lying in a second plane parallel to the first plane, is described.

14 Claims, 13 Drawing Sheets

FIG. 6
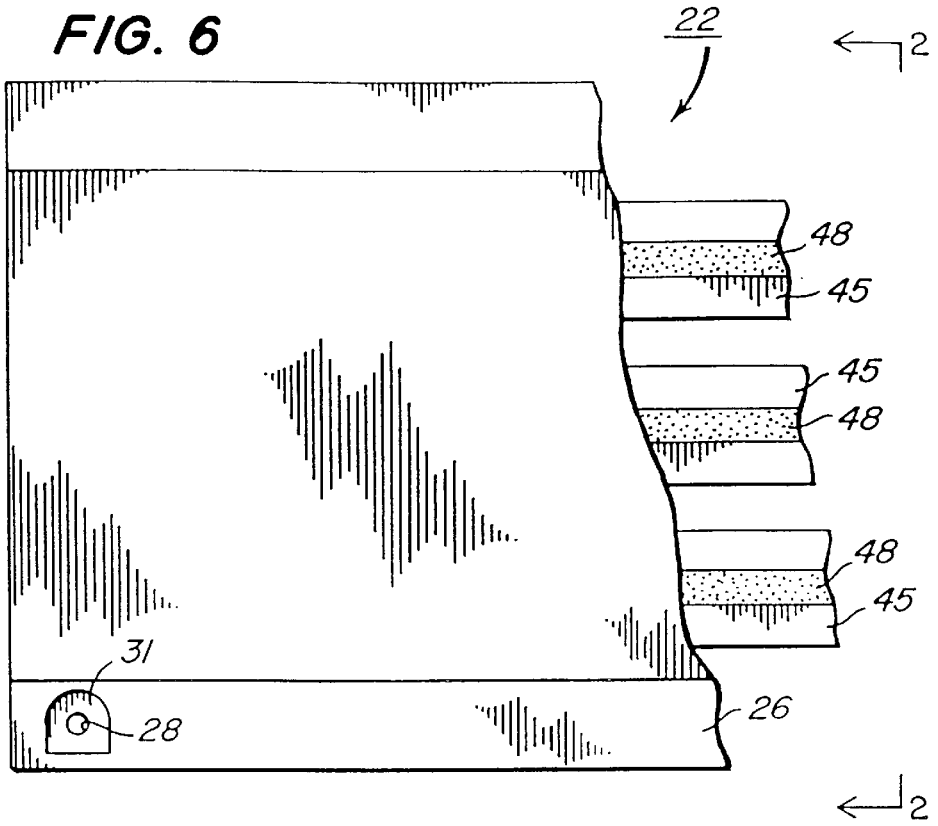
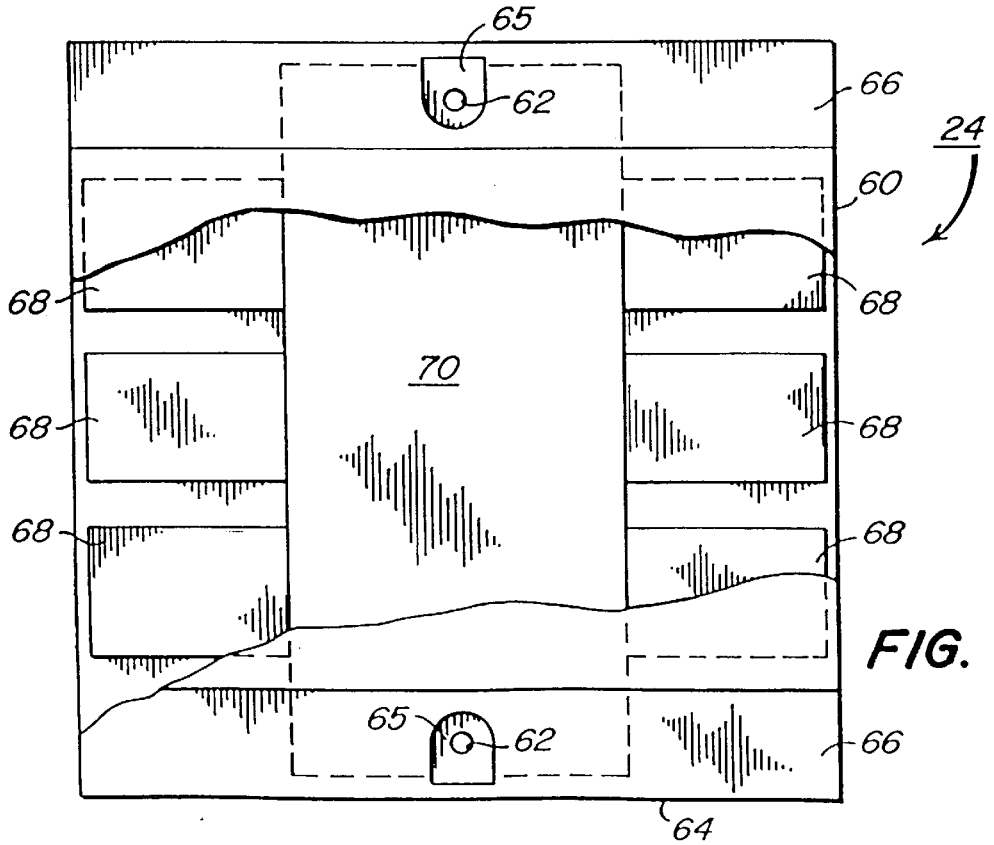
FIG. 7

FIG. 16
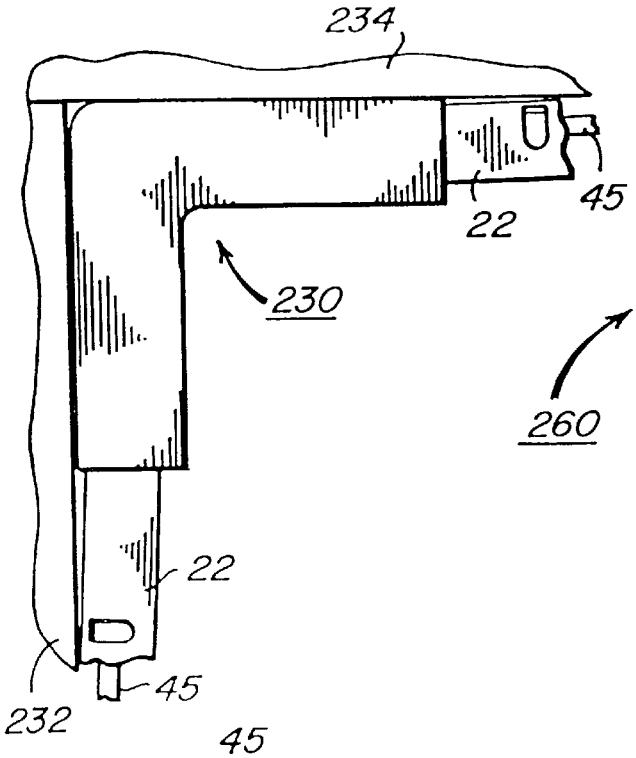
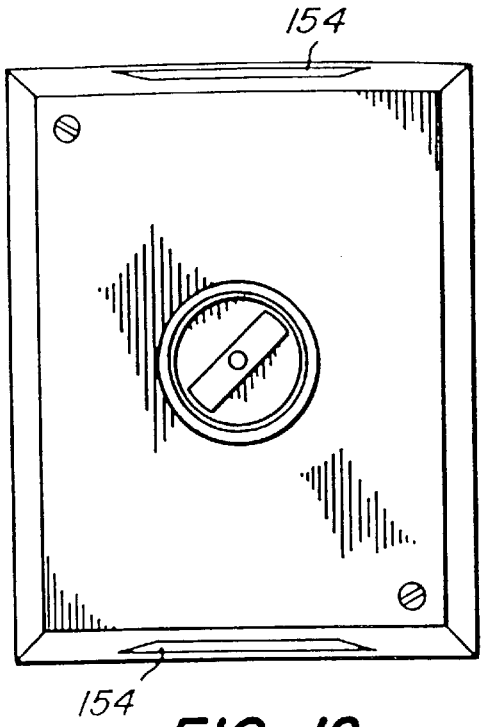
FIG. 18
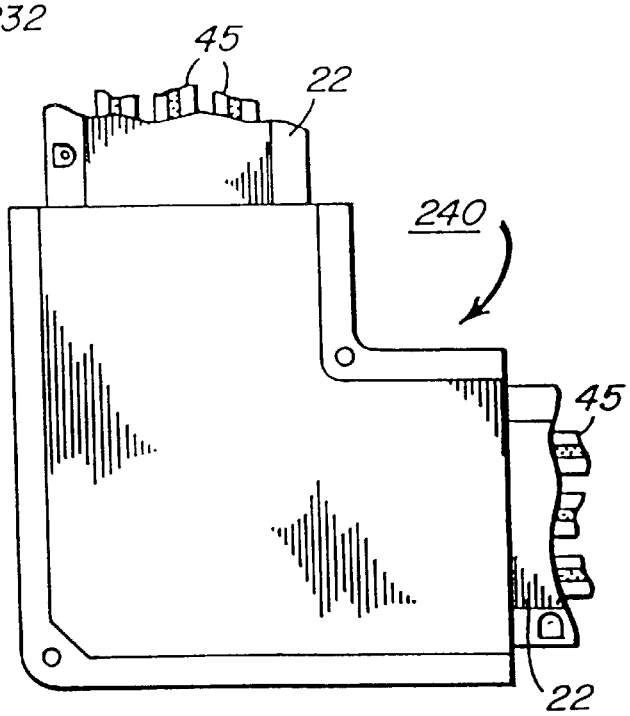
FIG. 17
FIG. 19
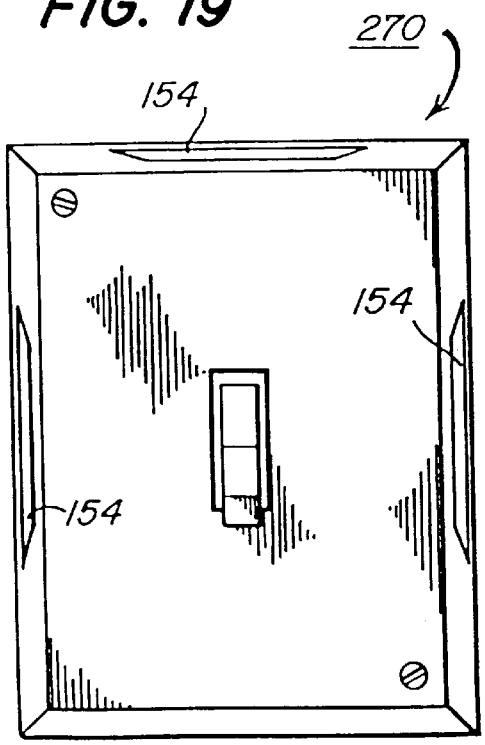

ELECTRICAL WIRING SYSTEM

This is a continuation-in-part of application Ser. No. 08/692,764, filed Aug. 8, 1996, U.S. Pat. No. 5,762,525.

FIELD OF THE INVENTION

This invention relates generally to an electrical wiring system having electrical components containing conducting metal strips which snap together without hardwiring, and in particular to a power adapter for connecting the components to a source of electricity.

BACKGROUND OF THE INVENTION

Hollow conduit has been used to enclose insulated electrical wires in installations where the wire has to be protected from the environment. Typically such conduit is used on exterior surfaces or underground. Bundles of wires are fed through a hollow casing and each wire is hardwired to outlets and switches fastened to the exterior surface of the casing in special boxes. Complete insulation and protection of hardwired systems is hard to achieve. Hard wiring is labor intensive and time consuming and, therefore, expensive.

U.S. Pat. No. 3,715,627 describes a pre-formed electrical wiring system with plug-in electrical components and lines which utilize conductive wires embedded within a flexible insulating material. Each line comprises a plurality of conductive wires and at least one soft metal wire to provide a means for forming a line to any required shape. The bare conducting wires extend from the insulation and connections between components are made with male-to-female plug-in connections. The wiring system is adapted for interior use and is embedded within a molded structure.

It is an objective of this invention to provide a pre-formed electrical wiring system which eliminates loose wires and hardwiring, is easy to install and is completely insulated from the environment.

It is another objective of this invention to provide a connector for electrically connecting two or more components of the wiring system together.

SUMMARY OF THE INVENTION

In a first aspect of the invention there is provided a wiring strip including an elongated insulating body having a substantially uniform cross section throughout its length and first and second substantially planar end surfaces at opposite ends of the strip; a plurality of generally flat, electrically conductive strips embedded in the body, extending through the body and terminating in the same planes of the first and second end surfaces; and a plurality of separate cavities formed in the body adjacent to the conductive strips, extending from each of the first and second end surfaces into the body, so that a surface portion of each conductive strip is exposed within the adjacent cavity for engaging an electrically conducting mating connector.

In another aspect of the invention there is provided an electrical wiring connector including an insulating body having a first end surface; a first cavity extending from the first end surface into the body and terminating at a first recessed end surface of the body; a plurality of first insulating projections recessed in the first cavity and cantilevered from the first recessed end surface; a plurality of conductive strips carried by the first insulating projections, each conductive strip having an exposed surface extending from the first recessed end surface to a distal end of each first insulating projection; a second end surface opposite the first end surface; a second cavity extending from the second end surface into the body and terminating at a second recessed end surface of the body; and a plurality of second insulating projections recessed in the second cavity and cantilevered from the second recessed end surface so that the plurality of conductive strips extend from the body and are carried by the second insulating projections, each conductive strip having an exposed surface extending from the second recessed end surface to a distal end of each second insulating projection.

In another aspect of the invention the electrical wiring system includes additional plug-in components such as electrical box outlets and switches, corner adapters and power adapters fitted with male connectors which extend the system without hardwiring.

In yet another aspect of the invention there is provided an electrical wiring connector having a generally rectangular flat base lying in a first plane; a generally rectangular cover matable with the base, the cover having a top and side walls extending from a surface of the top to the base, the base and cover when in mating relation defining an enclosed space; at least two openings in the cover, one opening in each of at least two of the side walls adjacent to the base; a plurality of separate, flat conductive strips carried by the base, each conductive strip having at least two ends, each conductive strip extending along a separate path between each of the at least two openings, each separate path traversing multiple planes; and a plurality of first terminals on respective ends of each conductive strip, each first terminal lying in a second plane parallel to the first plane.

In yet another aspect of the invention the wiring connector includes three separate conductive strips, each strip having four branches with an end terminal, the terminals of all of the branches lying in a plane, so that one terminal of each one of the three conductive strips is located adjacent to one terminal of each of the other two strips to form four sets of three terminals.

BRIEF DESCRIPTION OF THE DRAWINGS

FIG. 6 is a top plan view of the wiring strip of FIG. 2, partially cut away.

FIG. 7 is a top plan view of the connector of FIG. 1, partially cut away.

FIG. 16 illustrates a ceiling corner adapter.

FIG. 17 illustrates a wall corner adapter.

FIG. 18 illustrates a light socket.

FIG. 19 illustrates a wall switch.

DETAILED DESCRIPTION OF THE INVENTION

The pre-formed electrical wiring system of the invention provides a method for conducting electricity through an insulated casing. The electrical wiring system includes a wiring strip which is connected to an existing power source and is designed to be continued and assembled with other electrical components of the system such as connectors, adapters, electrical receptacle boxes and switches, without hardwiring.

In one embodiment for light industrial or domestic use the electrical wiring system includes a wiring strip, made of a substantially rigid insulating plastic, in which individual conducting cells are encased and insulated from each other by the plastic. A conducting cell carries a single metal conductor, with or without an insulating carrier for holding the metal conductor, and has a cavity adjacent to the metal conductor or the insulating conductor so that a female connector is formed. In an industrial version of this embodiment the plastic casing around the cells is encased in a metal body. In another embodiment for heavy industrial use the wiring strip has individual conducting cells which are insulated and encased in metal tubes, and the tubes are themselves encased in an insulating plastic. Each version of the wiring strip is assembled with other modular components of equivalent structure and materials. In all versions of the electrical wiring system modular components are designed to sealingly plug into each other and are thus assembled without hardwiring. The cavities and the conductors extend throughout the length of the wiring strip so that the wiring strip can be cut to any suitable length for connecting with other components of the system.

The electrical wiring system can be adapted to carry two or more conducting cells according to the electrical requirements for the job at hand. The conventional 2-wire, 2-wire with ground, or 3-wire with ground can be replaced with 2-cell, 3-cell or 4- cell systems respectively. The electrical wiring system of the invention is illustrated for use with a conventional alternating current 3-cell system having a positive, neutral and ground arrangement. The polarized arrangement of the conducting cells separates the positive (hot) cell and the neutral cell with the ground cell in the center of the arrangement. For ground fault interrupter (GFI) circuits this arrangement would favor a GFI trip should a fault situation occur. The modular design of the conduit is uniform through-out the system and polarization is maintained.

FIGS. 1–7 illustrate an embodiment of the invention which can be used in the home and for light industrial applications.

Figure 1:
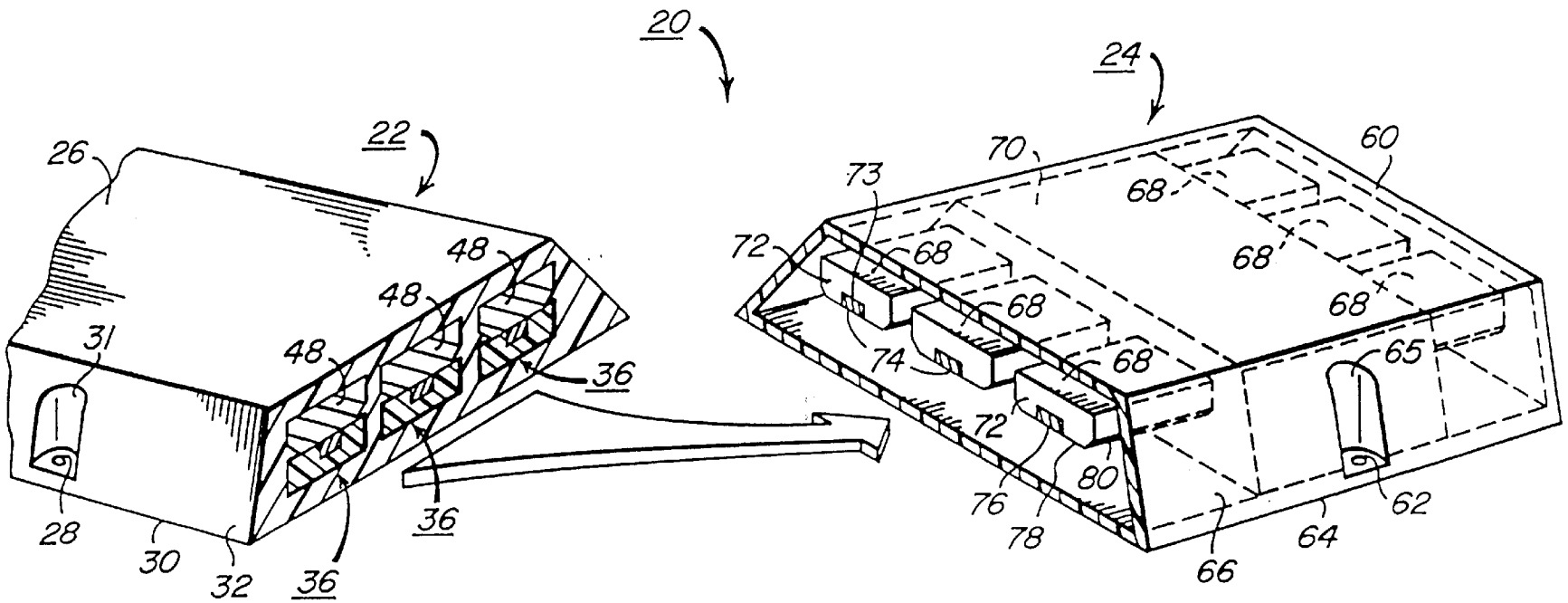
FIG. 1 is an isometic plan view of an electrical wiring system showing a wiring strip and a connector.
Figure 2:
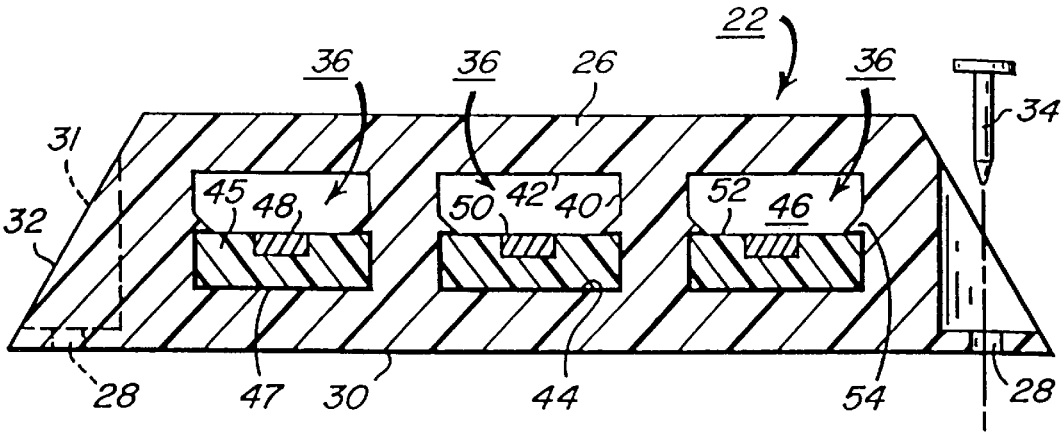
FIG. 2 is an end section view of a wiring strip.

Referring to FIGS. 1 and 2 there is illustrated an electrical wiring system 20 which includes a wiring strip 22 and a connector 24 designed to connect individual wiring strip sections together by male-to-female connections. The wiring strip 22 and the connector 24 are substantially rigid structures and cannot be bent over a small radius. Separate components with pre-formed shapes are used at bends and corners to re-route the wiring strip as necessary and are described in FIGS. 16–20 below.

The wiring strip 22 includes an insulating casing 26 of a plastic material. The casing 26 has a generally trapezoid shape with mounting holes 28 penetrating the flat base 30 and the angled side 32. The angled side 32 has a notch 31 for receiving a fastener 34. The fastener 34 is used to attach the wiring strip 22 to a flat structure such as a wall. The casing 26 encloses three conducting cells 36. Referring to FIG. 2, each conducting cell 36 leads a conductor through the wiring strip 22, the cell 36 having walls 40, a top 42 and a bottom 44. The walls of the cell 36 encompass an insulating carrier 45 and a cavity 46 formed by the carrier 45, the walls 40 and the top 42. Each carrier 45 includes a channel 47 and a conducting metal strip 48 embedded in the channel 47 so that the surface 50 of the metal strip 48 is level with the surface 52 of the carrier 45. The channel 47, cavity 46 and the embedded metal strip 48 extend the length of the carrier 45. The metal strip 48 and the cavity 46 thus form a female connector. The size of the metal strip 48 can be changed to provide desired current carrying capacity.

The cell 36 is preferably rectangular-shaped although other shapes can be used. In one embodiment of the wiring strip 22 the walls 40 of each cell 36 are provided with recesses 54 at the junction of the carrier 45 and the cavity 46 to capture and align a corresponding male prong and prevent its displacement.

Referring to FIGS. 1 and 7 there is illustrated an embodiment of a male connector 24 for connecting together lengths of the wiring strip 22. The connector 24 includes an insulating body 60 in the shape of a trapezoid with holes 62 through the base 64 and the angled sides 66. The angled side 66 has a notch 65 for receiving a fastener. The body 60 encloses three conducting through-prongs 68. A mid-portion of each through-prong 68 is surrounded by an insulator 70 so that each through-prong is isolated from each other through-prong. The through-prongs 68 are recessed within the body 60 and the body 60 is dimensioned to receive the wiring strip 22 therein in a sealing relationship. Each through-prong 68 is formed of a rigid, insulating holder 72 and includes a channel 73 and a conductive metal strip 74 embedded in the channel 73 of the through-prong 68 so that the surface 76 of the strip 74 is level with the surface 78 of the through-prong 68. The channel 73 and the metal strip 74 extend the length of the through-prong 68. The through-prong 68, together with the strip 74, thus forms a male connector. The body 60 provides a weather tight seal with the wiring strip 22. The seal can be enhanced by coating one or both of the contacting surfaces of the body and the wiring strip with an adhesive.

The through-prongs 68 are preferably rectangular shaped although other shapes can be used. In one embodiment of the connector 24 the through-prongs 68 are shaped with angled shoulders 80 for inserting the through-prongs 68 into the recesses 54 of the cell 36 (FIG. 2).

Figure 5:
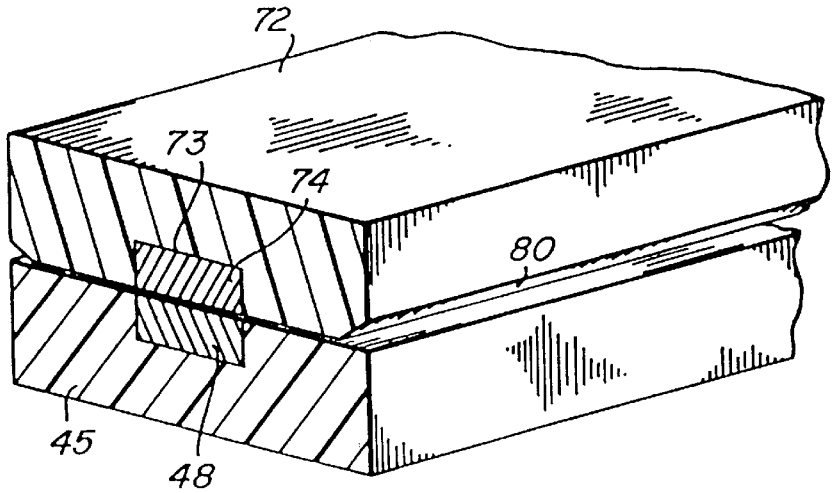
FIG. 5 is a partial view of an end section of conductors in contact.

Referring to FIG. 5, there is illustrated the manner in which conducting strips 48 in the carrier 45 of the female connector and the conducting strip 74 in the channel 73 of the male conductor make contact when the wiring strip and the connector are connected.

Referring to FIG. 6, there is shown a top cut-away view of the wiring strip 22 of FIGS. 1 and 2 with the insulating casing 26. The conductive metal strips 48 are embedded along the length of each carrier 45.

Figure 3:
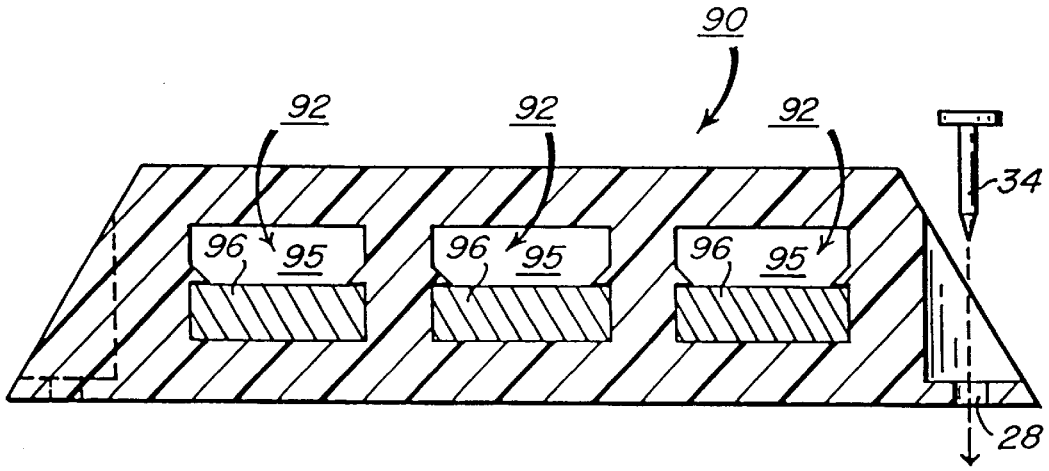
FIG. 3 is an end section view of a wiring strip.

Referring to FIG. 3, there is shown another embodiment of a wiring strip 90 having three conducting cells 92. Each conducting cell 92 includes a cavity 95 and a conducting bar 96 in which the bar 96 is made entirely of a metal conductor. Matching components, such as connectors corresponding to connector 24, for use with the wiring strip 90 would be provided with all metal through-prongs.

Figure 4:
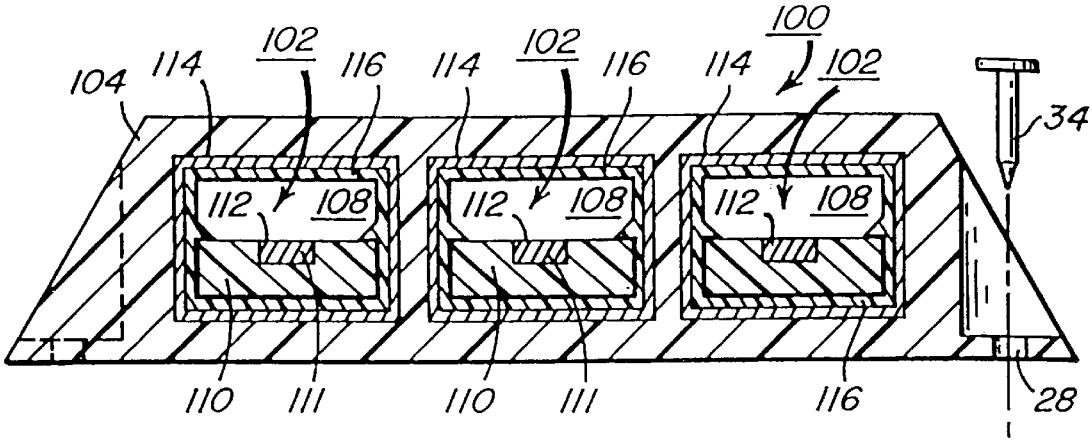
FIG. 4 is an end section view of a wiring strip.

Referring to FIG. 4, there is illustrated another embodiment of a wiring strip 100 with conducting cells 102 embedded in an insulating casing 104. Each conducting cell 102 has a cavity 108 and an insulating carrier 110. The carrier 110 includes a channel 111 and a conductive metal strip 112 embedded in the channel 111. To provide additional support and protection a metal tube 114 surrounds the cell 102 and an insulating layer 116 lines the metal tube 114.

Figure 8:
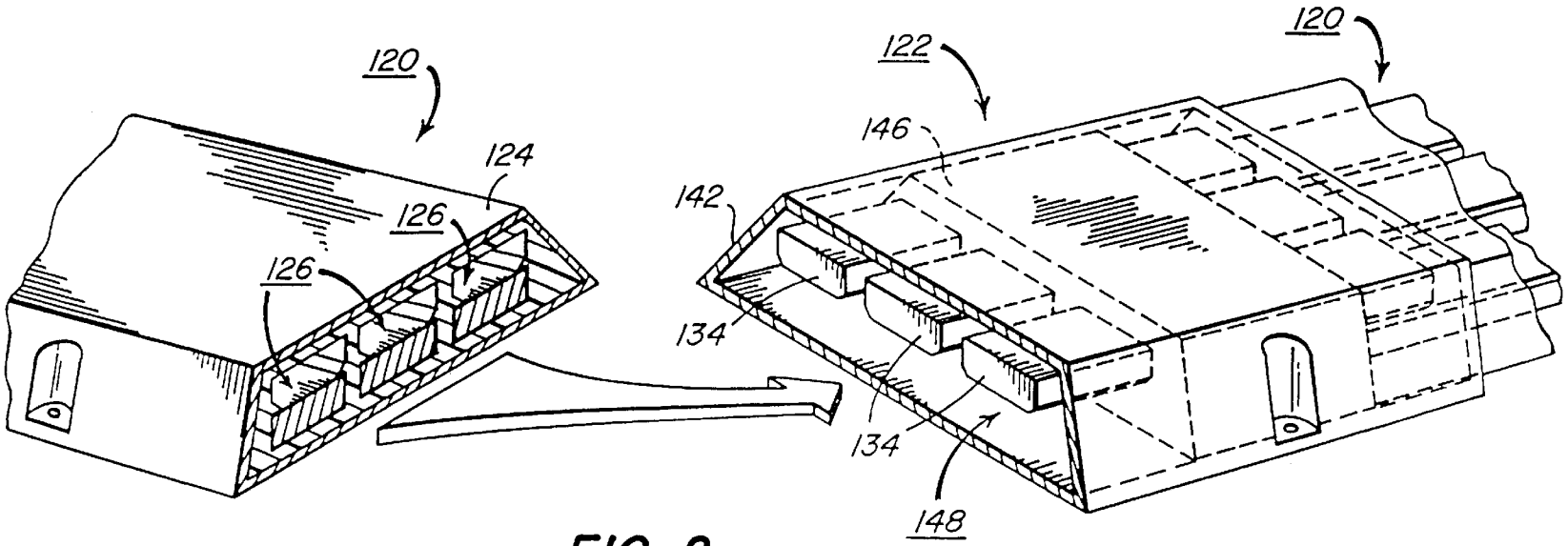
FIG. 8 is plan view of an electrical wiring system showing a wiring strip and a connector.
Figure 9:
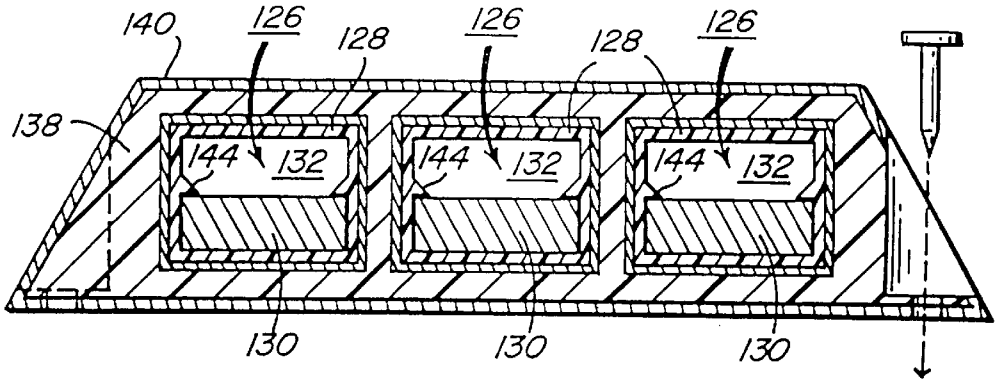
FIG. 9 is an end section view of a wiring strip.

FIGS. 8 and 9 illustrate an embodiment of the electrical wiring system of the invention for heavy industrial use. Rectangular shaped wiring strips and adapters are illustrated which can be mounted on walls with clamps and straps. Other shapes with provisions for mounting holes are also contemplated.

Referring to FIG. 8 there are shown two wiring strip sections 120 and a male connector 122 designed to connect the two wiring strip sections 120 together. The wiring strip 120 is of a substantially rigid construction and cannot be bent over a small radius. Separate elements with pre-formed shapes can be used at bends or corners as required. The wiring strip 120 includes a metal cover 124 which encloses three insulated conducting cells 126.

Referring to FIG. 9, each of the cells 126 is constructed with a metal tube 128. The metal tube 128 is partially filled with an electrical conductor 130. In this embodiment the conductor 130 fills approximately half of the tube volume and is an all metal bar. The cavity 132 is sized to receive the conducting through-prongs 134 of the connector 122. The metal tube 128 and conductor 130 are preferably rectangular shaped although other shapes can be used. In a preferred embodiment the cover 124 is further strengthened with an insulating filler 138 between the cells 126 and the cover walls 140. An insulating layer 144 lines the inside of the metal tube 128.

Referring again to FIG. 8, there is illustrated an embodiment of an industrial male connector 122. This embodiment has three all metal conducting through-prongs 134 enclosed within a metal body 142. An insulator 146 surrounds each of the through-prongs 134 to isolate the through-prongs from each other and from the metal body 142. The connector 122 is constructed so that the through-prongs 134 are recessed in the body 142. The body 142 is sized so that it can receive the cover 124 of the wiring strip 122 when the through-prongs 134 are inserted into the cavity 132 of the wiring strip 120 and the through-prongs 134 contact the conductors 130. The recess portion 148 of the connector can have any desired length as required. The metal body 142 provides a weather tight seal with the wiring strip 120.

The connectors of FIGS. 1 and 8 have through-prongs sized and shaped to fit in the cavities defined within the conductor cells of the wiring strip.

It will be apparent that the all metal conductors of the industrial-type cells and through-prongs can be replaced by insulating carriers partially filled with metal conducting strips as described above.

In all the embodiments of the electrical wiring system of the invention the metal conductors used to form the conductor strips and the all metal conductors can be any suitable conducting metal or metal alloy, such as copper, aluminum, copper clad aluminum and copper alloy.

The insulating compositions used throughout the system, for example to form the substantially rigid wiring strip, the conductor cell carrier and the conductor through-prongs can be the same or different. The compositions should be resistant to cracking due to extremes of heat and cold. Suitable insulating compositions with the desired insulating properties, strength and rigidity over the required temperature ranges include plastics, such as thermoplastic and thermosetting resins. Suitable resins include polycarbonates (PC), acrylonitrile-butadiene-styrene resins (ABS) and poly (phenylene oxide) resins (PPO). The heavy duty versions of the wiring strip in which the conductor cell is housed within a metal tube have, in addition, an insulating material between the metal tube and the cell. This insulating material may be selected from the insulating materials described above and from more flexible materials, such as a rubber, for example a silicone rubber.

The metal cover 124 and the metal body 142 in the industrial version are preferably formed from a semi-rigid metal, for example aluminum, which is resistant to weather and corrosion since many of the applications for wiring strip are on outside surfaces or underground. Similarly, the metal tube surrounding the channel portion in some embodiments is made of a semi-rigid metal, such as aluminum.

The wiring strips and connectors are formed by conventional extrusion or molding techniques which are well known to those with ordinary skill in the art to which it pertains. For example, the plastic insulating compositions can be co-extruded or molded with the conductors. Alternatively the plastic compositions are extruded or molded separately to pre-form the conducting cells. The conductors are then inserted into the conducting cells. The conductors may, in addition, be adhesively attached to the cell. The wiring strips and connectors are designed to be integrated into other electrical components of the electrical wiring system. The structure and materials of the other electrical components are selected to match the type of wiring strip being used.

Figure 10:
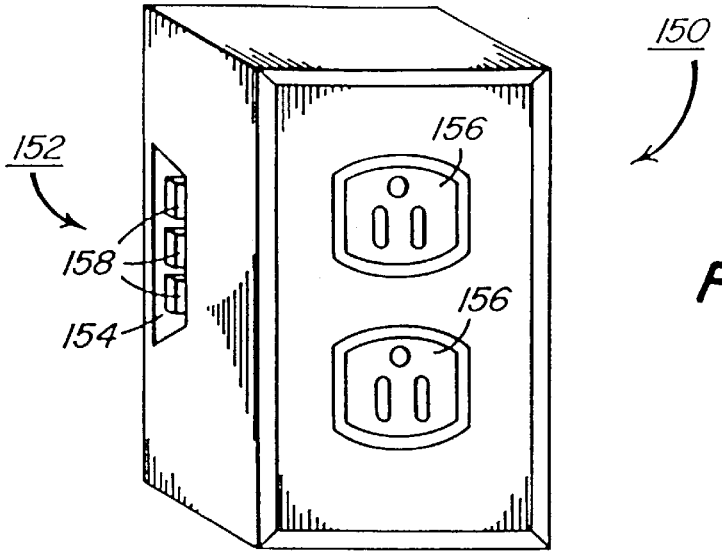
FIG. 10 illustrates an angled view of an outlet box.

Referring to FIG. 10 there is shown a receptacle box 150 which has an opening 152 containing a male connector 154 integrated electrically with the sockets 156 and adapted to receive the end of the female wiring strip, for example wiring strip 22. The male connector 154 includes connector prongs 158 which have the same construction as the male through-prongs, for example through-prongs 68 described for the connector 24. The opening 152 is sized to receive the casing 26 of the wiring strip 22 when the wiring strip 22 is plugged into the receptacle box 150. The receptacle box 150 can be provided with two male connectors 154, one connector 154 on each side, to allow the wiring strip to be led through the box 150. Each connector 154 being electrically connected with the other, for example by bus-bars. The construction and materials of the male connector 154 are the same as for the connectors described above.

Figure 11:
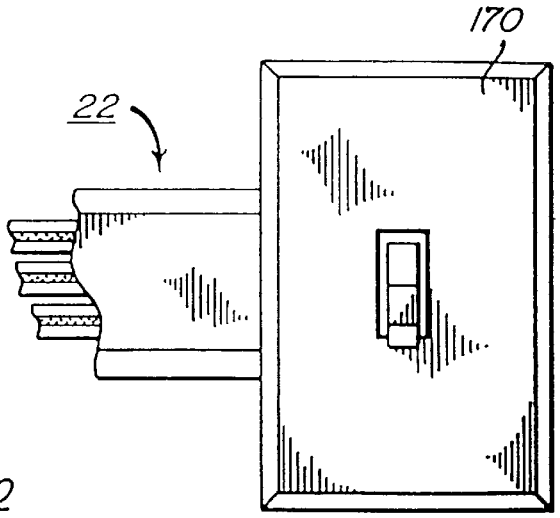
FIG. 11 illustrates a switch box.

Referring to FIG. 11, there is shown a front view of a wall switch 170 which can be adapted in the same manner as the above described receptacle box to receive the wiring strip 22 directly.

Figure 12:
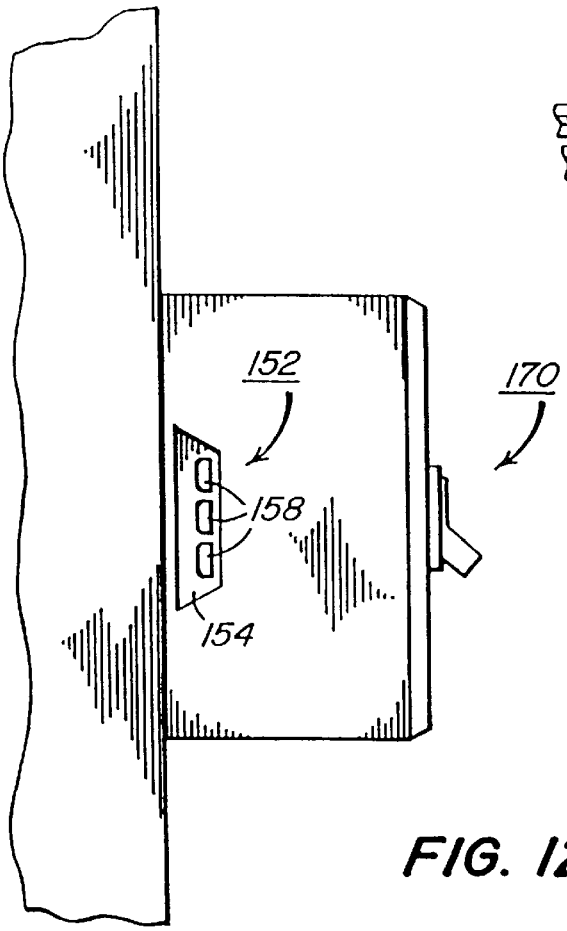
FIG. 12 illustrates a side view of a switch box.

Referring to FIG. 12, there is shown a side view of the wall switch 170 with a cavity 152 containing a male connector 154 on one side. The male connector 154 has connector prongs 158. The prongs 158 have the same construction as the male connector prongs 68 described above.

Installation of the electrical wiring system requires a connection to an existing power source. This connection can be achieved in a number of ways, for example, by plugging a power adapter into an existing conventional wall socket and then plugging a wiring strip into male connectors of the power adapter.

Figure 13:
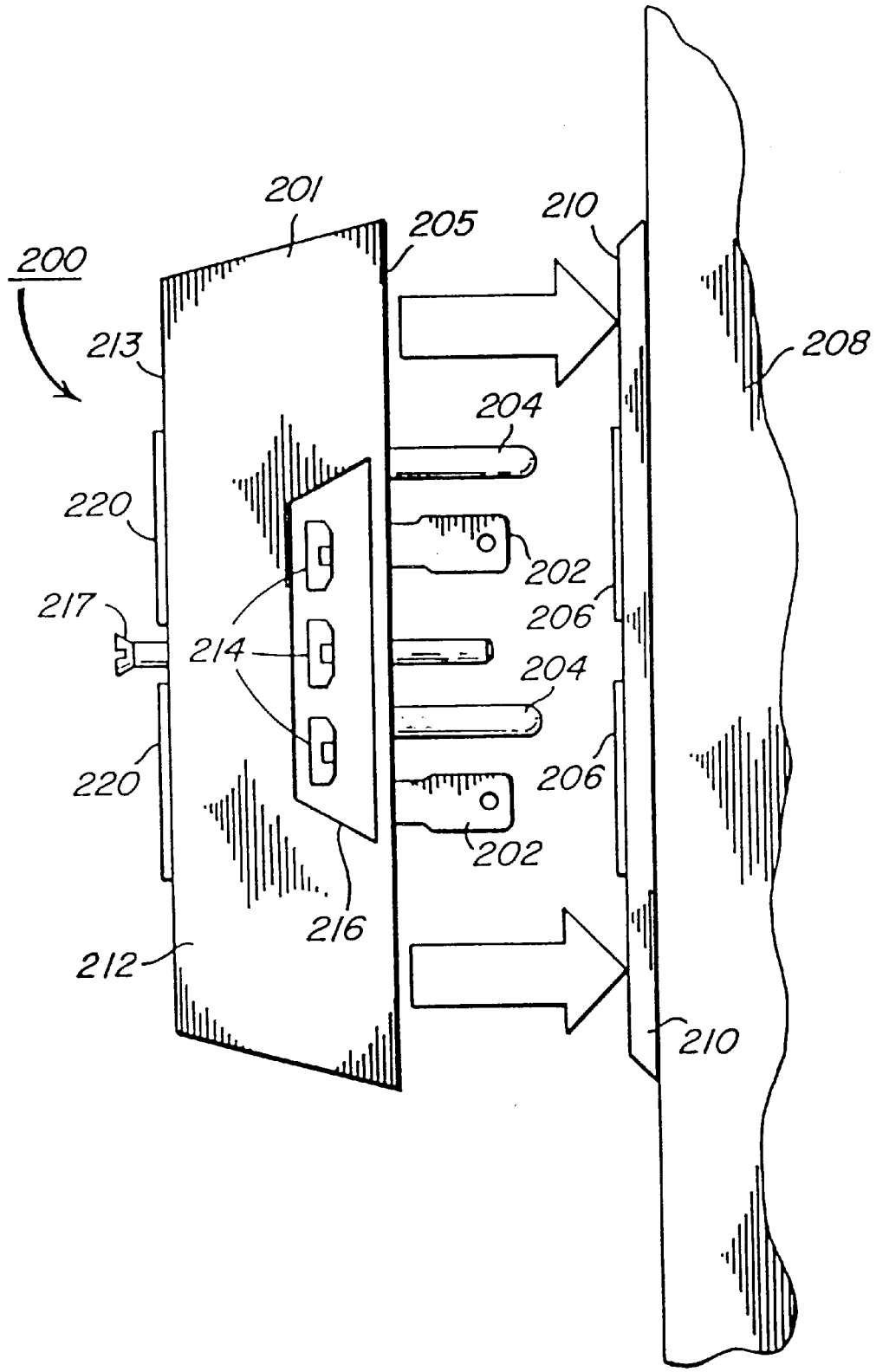
FIG. 13 is a side view of a power adapter.
Figure 14:
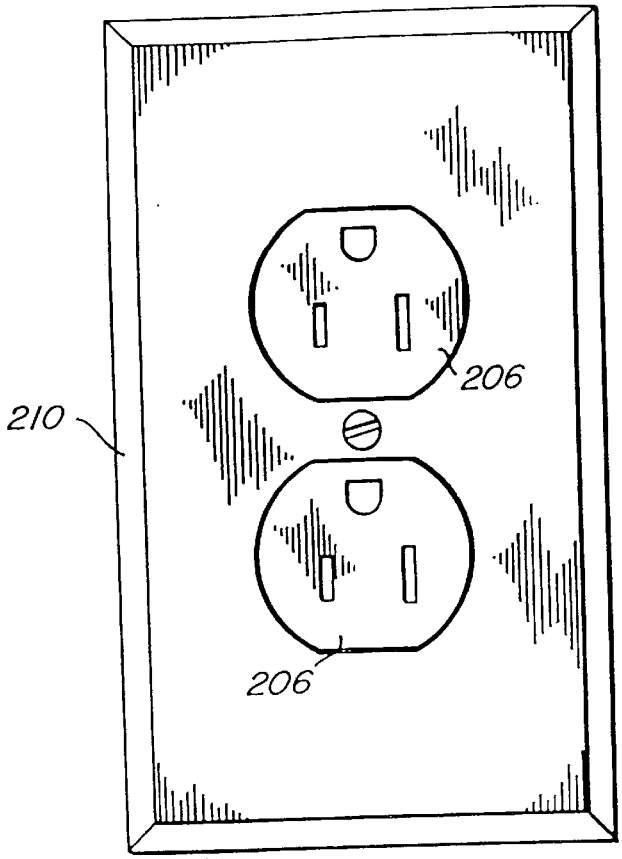
FIG. 14 PRIOR ART
FIG. 14 illustrates a conventional duplex wall switch.
Figure 15:
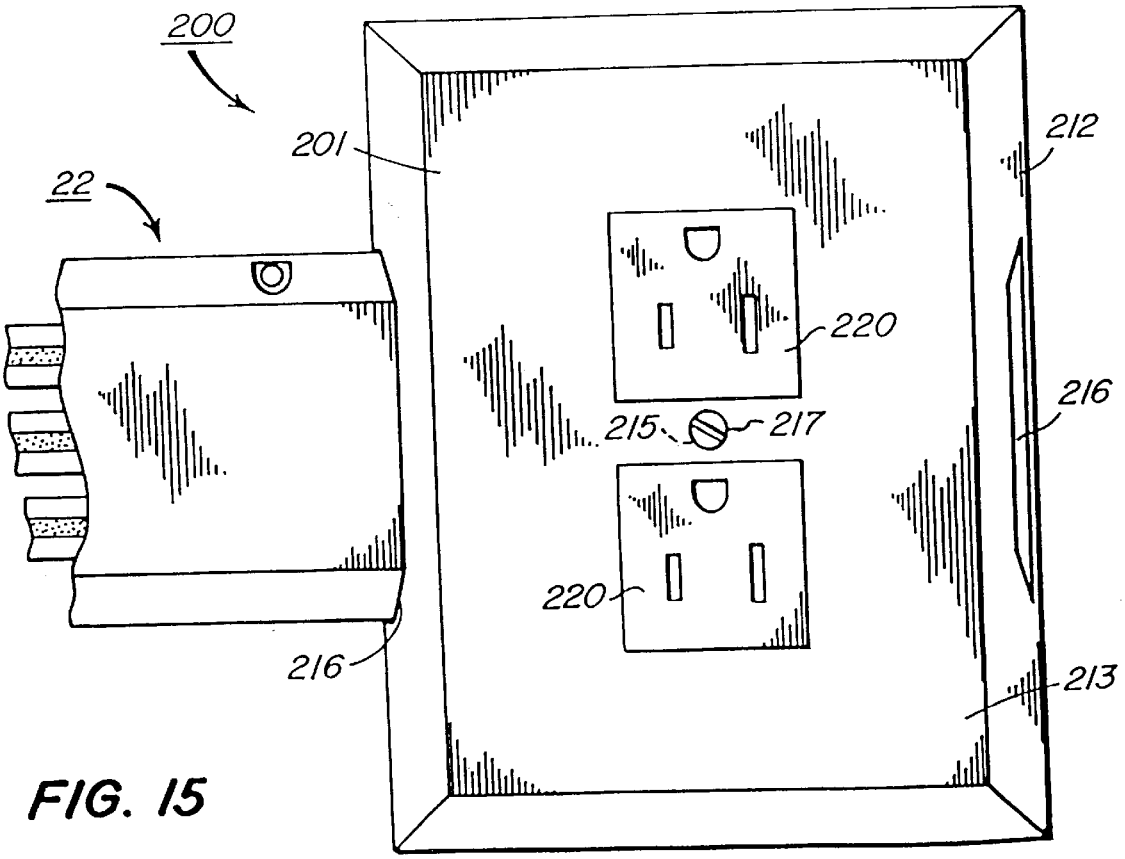
FIG. 15 illustrates a top view of a power adapter.

FIGS. 13 and 15 illustrate a duplex-type power adapter 200. The adapter includes a housing 201 which is fitted with conventional conductive pins, for example hot pins 202 and ground posts 204 for plugging into an existing conventional 3-prong duplex wall receptacle 206 (FIGS. 13 and 14).The conductive pins 202, 204 protrude from the back 205 of the housing 201. The duplex wall receptacle 206 is normally mounted in a receptacle box which is recessed in a wall 208 and is conventionally wired to a power source. A wall plate 210 of the receptacle box is mounted flush with the wall 208. The side walls 212 of the power adapter 200 extend beyond the back 205 so that the housing 201 mounts over the wall plate 210 and forms a weather tight seal with the wall 208. The wall plate 210 is usually removed before the power adapter is connected. The housing 201 is provided with a mounting hole 215 and fastener 217 for attaching the power adapter 200 to the duplex wall receptacle 206. The housing 201 is provided with the male connectors 214 mounted in cavities 216 on one or more side walls 212 of the housing 201 to which a wiring strip 22 can be connected (FIG. 15) and thus the circuit can be extended from the power adapter 200. In a preferred embodiment the adapter is also provided with duplex receptacles 220 mounted in the front 213 of the housing 201 for receiving conventional wired plugs. Internally the power adapter male connectors 214 and the conventional pins 202 and posts 204 are connected by conventional bus-bar connections which are well known to those with ordinary skill in the art to which it pertains.

The circuit can be extended in different directions and around inside and outside corners by means of appropriately shaped and angled double male connectors constructed in the same way as the connector 24 of FIG. 1.

FIGS. 16 and 17 illustrate two angled embodiments of such corner-connectors. FIG. 16 illustrates a ceiling-type connector 230 in which wiring strip 22 is plugged into male connectors at each end, thus enabling the circuit to be extended from a wall 232 to a ceiling 234. FIG. 17 illustrates a wall-type connector 240 in which wiring strip 22 is plugged into male connectors at each end, thus enabling the circuit to be extended from a horizontal direction to a vertical direction on a wall. In a preferred embodiment of the connectors 230, 240 the connectors are constructed with the same materials as the connector 24 (FIG. 1) and the male connectors are through-prongs adapted to the L-shape of the corner-connectors.

FIG. 18 illustrates a light socket 260 with male connectors 154 built into two sides for extending the circuit.

FIG. 19 illustrates a wall switch 270 with male connectors 154 built into three sides for extending the circuit.

Figure 20:
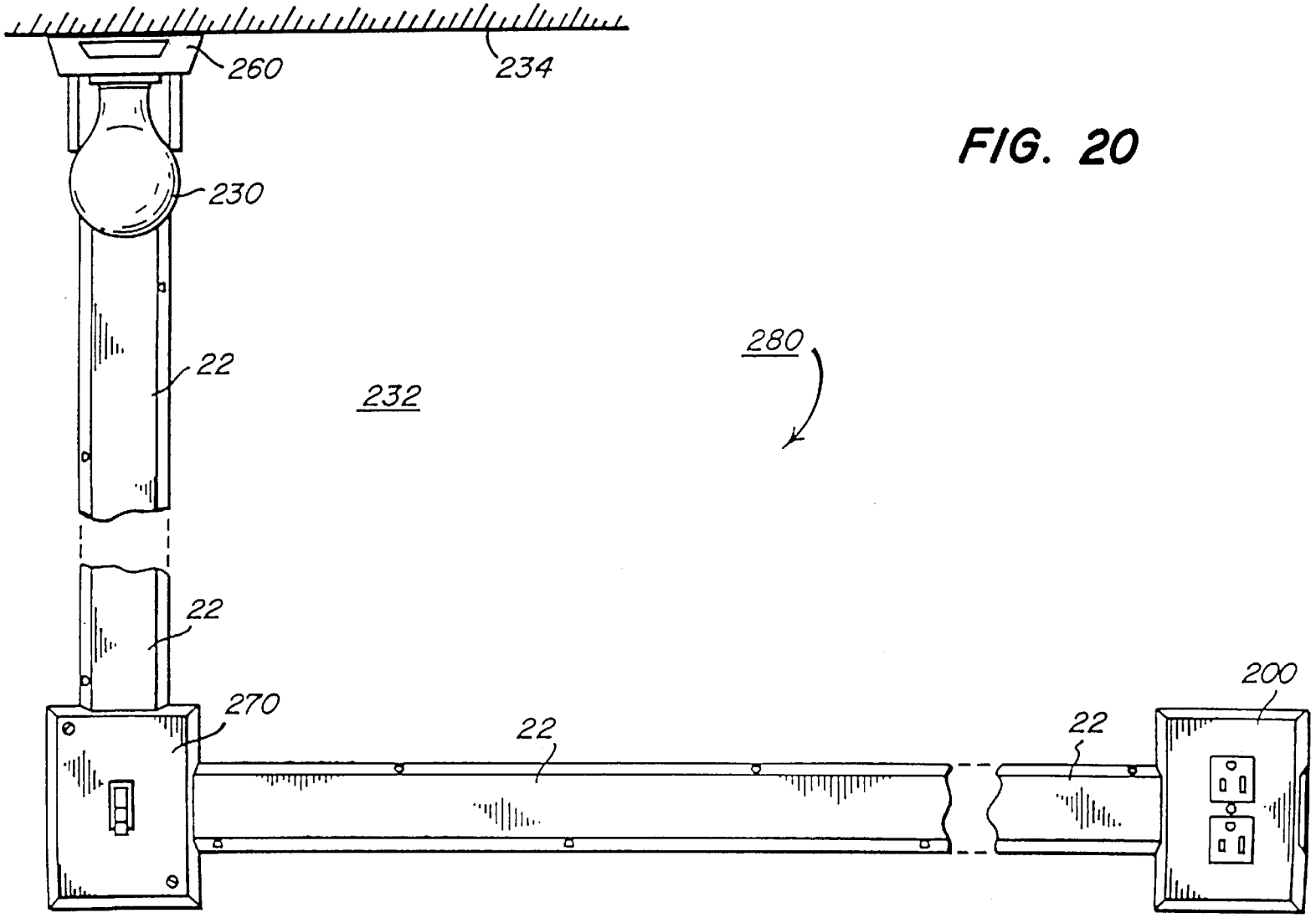
FIG. 20 illustrates an electrical circuit.

FIG. 20 illustrates a circuit 280 consisting of the power adapter 200, wiring strip sections 22, a wall switch 270, the ceiling connector 230 and light socket 260.

FIGS. 21–28 show additional embodiments of the electrical wiring system in which the wiring strip has a cavity adjacent to each of two opposing surfaces of each conducting metal strip and the connector includes a plurality of conductive strips, each of which terminates in a clip for connecting to the corresponding conducting metal strip of the wiring strip. The clips can be incorporated in components of the system fitted with male-type connectors, such as electrical box outlets and switches, corner adapters and power adapters, to connect with the female-type terminals of the wiring strip and extend the system without hardwiring. The insulating materials and the conducting metals for these embodiments are selected from those described above for other components of the wiring system.

Figure 21:
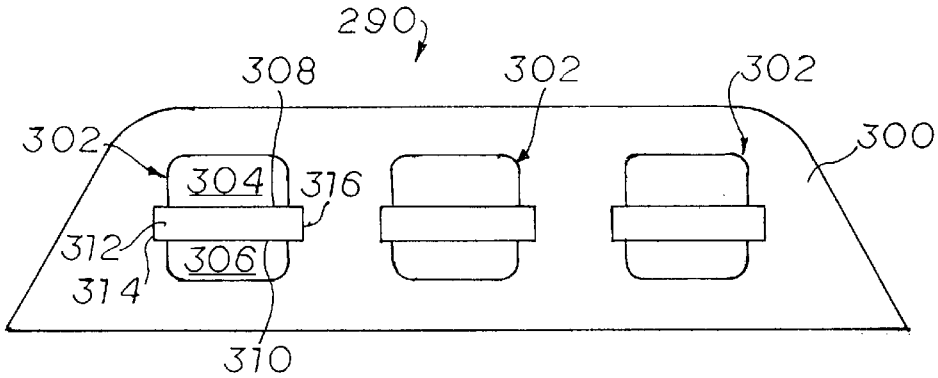
FIG. 21 illustrates an end section view of a wiring strip.
Figure 22:
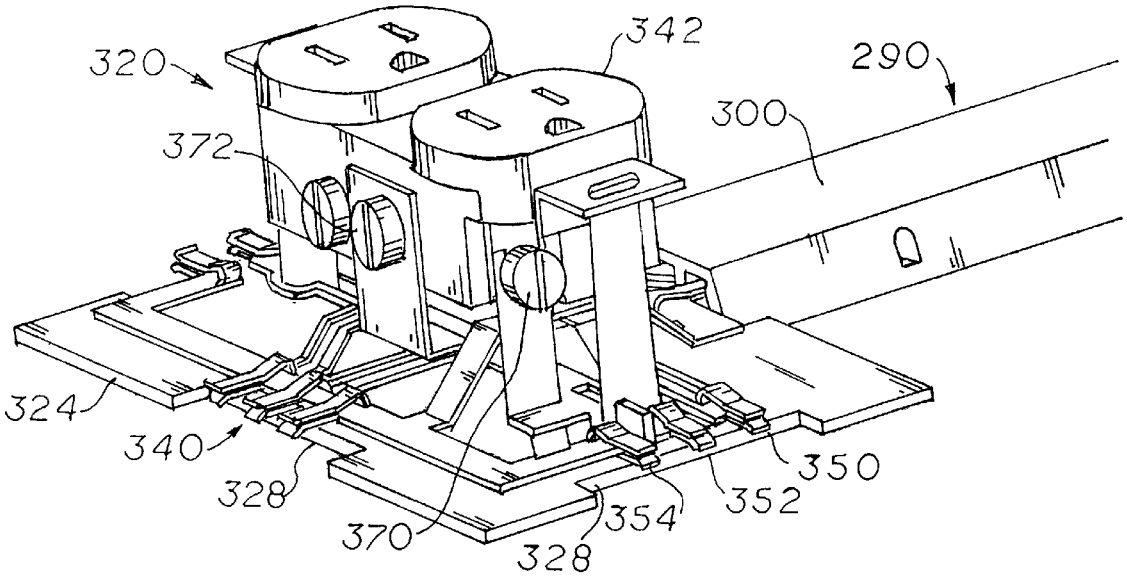
FIG. 22 illustrates a plan view of a connector connected to a wiring strip.

Referring to FIGS. 21 and 22, there is shown an electrical wiring strip 290 having an insulating body 300 surrounding three conducting cells 302 and separating the cells 302 from each other. The materials and external design of the strip 290 are essentially the same as described above for wiring strip 22 of FIG. 1. Each conducting cell 302 includes a pair of cavities 304, 306 adjacent opposite surfaces 308, 310, respectively, of a conducting strip 312. Opposite edges 314, 316 of the conducting strip are embedded in the insulating body 300. The cavities 304, 306 and the conducting strip 312 extend throughout the length of the wiring strip 290. The wiring strip 290 can be cut to any suitable length for connecting with other components of the wiring system. The wiring strip 290 is mated with a connector 320.

Figure 23:
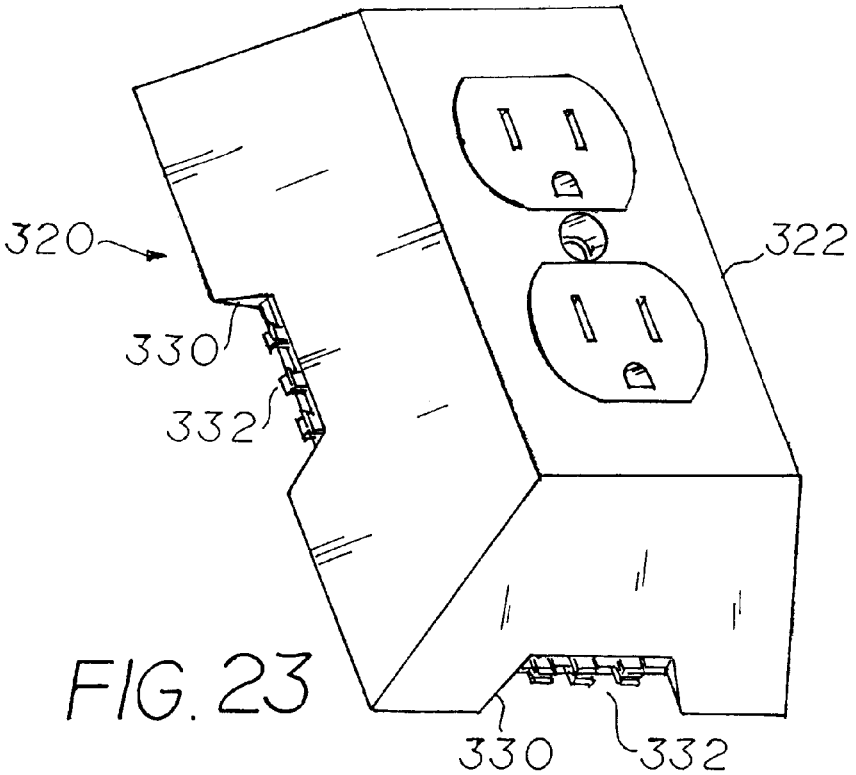
FIG. 23 illustrates a top view of a power adapter.
Figure 24:
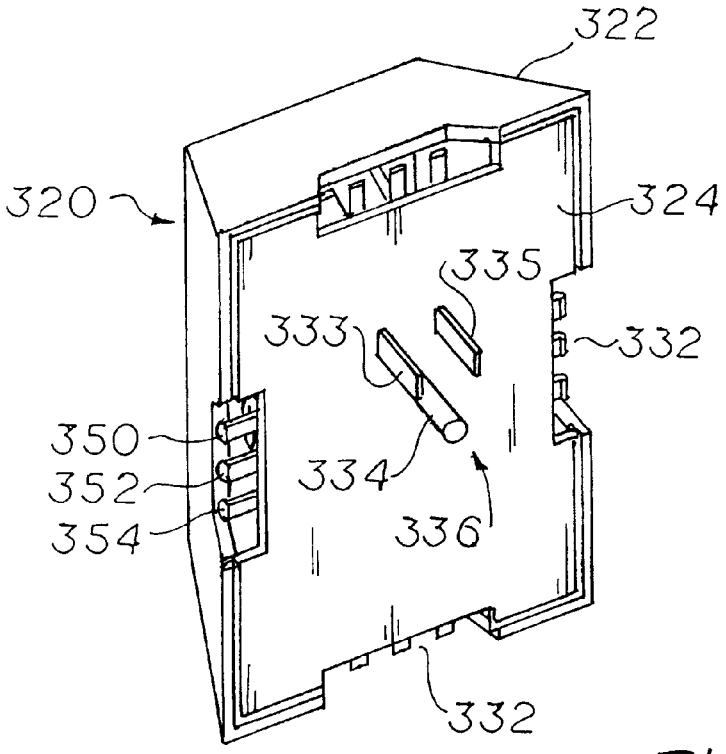
FIG. 24 illustrates a bottom view of a power adapter.

Referring to FIG. 22, the generally rectangular-shaped cover 322 (FIG. 23) of the connector 320 has been removed so that the interior of the connector 320 can be seen. FIGS. 23 and 24 illustrate top and bottom views of the connector 320 with the cover 322 in place. The connector 320 has a rectangular-shaped base 324 configured to fit within the perimeter 326 of the cover 322. A plurality of notches 328 in the base and corresponding notches 330 in the cover form a plurality of openings 332 in the connector 320 when the base 324 and the cover 322 are mated and the notches 328, 330 are in registration with each other. Disposed within the openings 332 are three male-type terminals 350, 352, 354 of a grid 340 of conductors 342, 344, 346 (see FIG. 25) which provide electrical connections with the wiring strip 290 to extend the wiring system. The openings 332 are sized so that when the conducting strips 312 are connected to the terminals 350, 352 and 354, the wiring strip body 300 fits tightly within the perimeter of an opening 332.

In a preferred embodiment of the connector 320, the base 324 of the connector is fitted with conventional hot 333 and neutral 335 blades and a ground post 334 to form a conventional three-prong plug 336 for connecting to a power source. The power is transmitted from the plug 336 to a grid 340 of conducting strips by bus-bar connections. The grid 340 of conducting strips, which is described in detail below, is attached to the base 324 by screws or rivets through the individual conducting strips. Such a connector can be used as a power adapter for activating the wiring system.

Referring again to FIG. 22, in another preferred embodiment of the connector a duplex receptacle 342 is electrically connected to the grid 340 by bus-bar connections, for example 370, 372, to provide additional outlets for electrical appliances to be attached to the wiring system.

A preferred embodiment of the grid 340 of conducting strips for a connector of the invention is shown in FIGS. 25–28.

Figure 26:
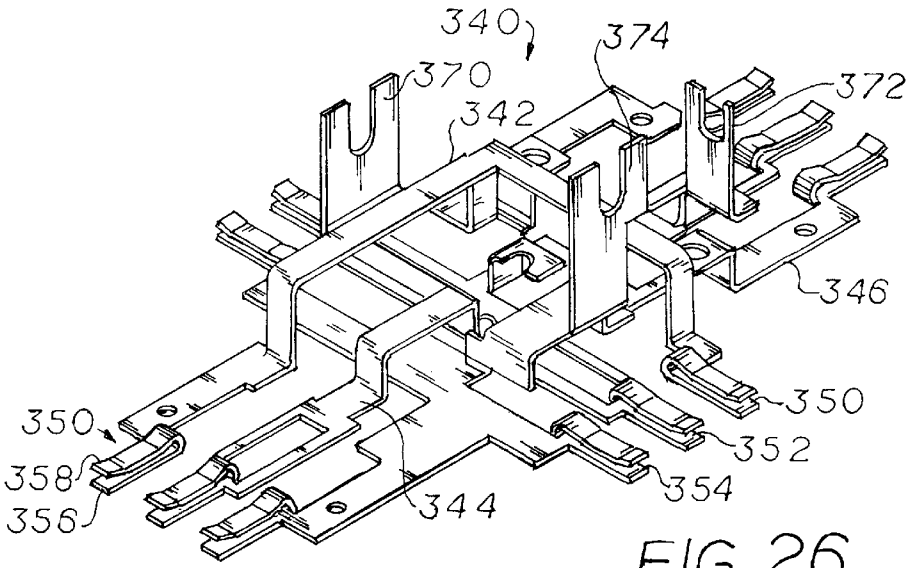
FIG. 26 illustrates a plan view of a connector wiring grid.
Figure 25:
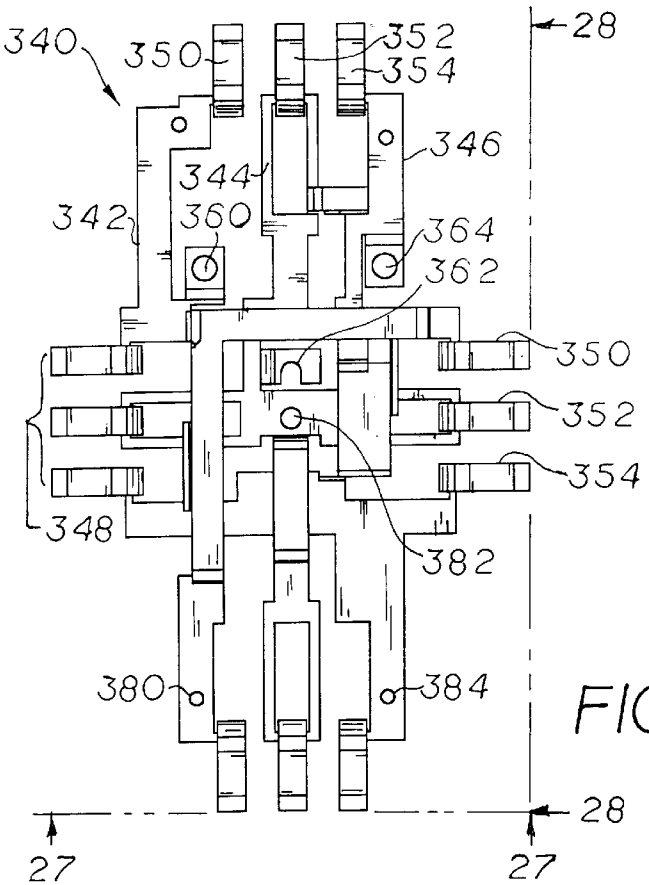
FIG. 25 illustrates a top view of a connector wiring grid.

Referring now to FIG. 25 there is shown a top view of a grid 340 of three metallic conductors having separate hot 342, ground 344 and neutral 346 conductors, each conductor having four branches with terminal ends. The grid 340 is configured to provide four sets 348 of male terminals, one set 348 in each opening 328 of the rectangular connector 320. In a preferred embodiment of the grid 340, each set 348 includes spring clip type terminals 350, 352, 354 for the hot, ground and neutral conductors respectively. The four sets of terminals lie in essentially the same horizontal plane and the ends of the clip terminals of each set lie in a plane at right angles to the horizontal plane Each of the conductors 342, 344 and 346 are stamped from a single sheet of metal and are shaped and bent at angles so that the member conductors can be assembled into a grid without making contact with one another. Each conductive strip extends along a separate path between each of the openings and each separate path traverses multiple planes. FIG. 26 shows how the individual conductors 342, 344 and 346 are formed with generally rectangular shapes and that right-angled bends are used to pass the conductors over and/or under other members of the grid without contacting each other. It will be apparent that other shapes and different angles could be utilized to form the grid 340.

Figure 28:
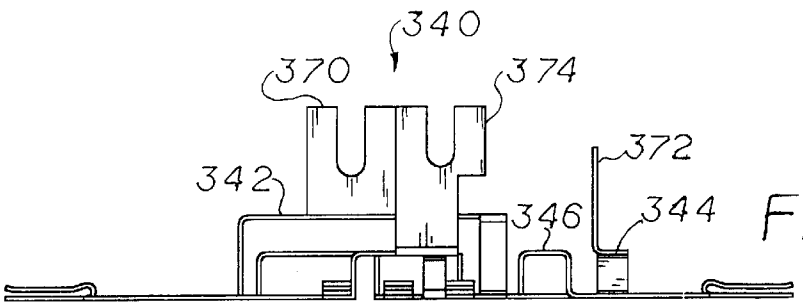
FIG. 28 illustrates a side section view of the grid of FIG. 26, taken along the line 28—28.
Figure 27:
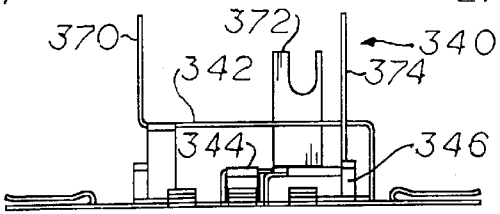
FIG. 27 illustrates a front section view of the grid of FIG. 26, taken along the line 27—27.

Referring to FIGS. 27 and 28, there are shown front and right side sectional views of the grid 340, respectively, which further illustrate the arrangement of the conductive strips 342, 344 and 346.

Referring again to FIGS. 25, 26 the clip terminals 350, 352 and 354 are formed at the ends of the respective conductive strips. Each clip terminal, for example terminal 350, is formed from two metal strips 356 and 358 which are stamped from a sheet of the conducting metal when conductive strip 342 is formed. One of the strips 358 is bent over and aligned parallel with the other strip 356 to form the generally U-shaped spring clip 350. When the clip 350 is forced onto the conductive strip 312, causing the strips 356, 358 to spread apart, firm electrical contact with strip 312 is established (FIG. 21). Similarly, all the other clip terminals grip a corresponding conductive strip of a wiring strip 290.

To form a power adapter 320 for connecting with a source of electrical current, each of the conductive strips 342, 344, 346 is provided with an aperture 360, 362, 364 respectively for attaching the blades 333, 335 and post 334 of plug 336. The blades and post can be attached, for example, by threaded connections or by soldering.

In another embodiment of the connector 320, each of the conductive strips 342, 344, 346 has an upstanding terminal 370, 372, 374 extending from an edge of the respective conductive strips for attaching to corresponding hot, ground and neutral terminals of the receptacle 342.

To complete the assembly of a connector 320, each of the conductive strips 342, 344, 346 is provided with mounting apertures 380, 382, 384 for attaching the conductive strips to the base 324 with fasteners, such as screws or rivets.

It will be readily apparent to those with skill in this art that connectors with one, two or three sets of terminals could be manufactured by using appropriate stamping dies.

In another preferred embodiment of the wiring system of the invention unused sets of terminals of a connector, such as 320, can be provided with insulated caps. Such caps protect the exposed terminals from the environment and prevent accidental contact with the terminals.

The electrical wiring system is readily adapted to meet current recommendations and codes for electrical circuits. The insulators and conductors can be selected, sized and combined to match the temperature and overcurrent protection ratings of conventional wiring systems. The size of the metal conducting strip can be changed to provide desired current carrying capacity.

The current carrying capacity of standard sizes of Romex-type copper wire covered by different insulators and the corresponding temperature ratings are given in Table 1.

TABLE 1

| Current Carrying/Ampacity Values (amps) | | | | |
|---|---|---|---|---|
| Wire size | | Temperature Rating/Insulation Type | | |
| AWG | Area ($in^2$) | 60° C./TW | 75° C./THHN | 90° C./THHN |
| 14 | .003 | 20 | 20 | 25 |
| 12 | .005 | 25 | 25 | 30 |
| 10 | .008 | 30 | 35 | 40 |

The overcurrent protection for conductor types shown in Table 1 should not exceed 15 amps for size 14, 20 amps for size 12, and 30 amps for size 10 wires after any correction factors for ambient temperature and the number of conducting wires have been applied.

In the wiring system of the invention the current carrying capacity of different sizes of single insulated copper alloy conducting cells with different insulators and the corresponding temperature ratings are given in Table 2.

TABLE 2

| Current Carrying/Ampacity Values (amps) | | | |
|---|---|---|---|
| Wire Size | Temperature Rating/Insulating Type | | |
| Area ($in^2$) | 60° C./ABS | 113° C./PC + ABS | 116° C./PPO |
| .003 | 20 | 40 | 40 |
| .005 | 40 | 40 | 40 |
| .008 | 40 | 40 | 40 |

The overcurrent protection for conducting cells shown in Table 2 should not exceed 30 amps for all categories after any correction factors for ambient temperature and the number of conducting cells have been applied.

The electrical wiring system of the invention replaces the conventional method of installing hollow conduit to an exterior wall to assemble outlets and switches where wire bundles are then fed through the hollow casing and outlets and switches must be hardwired. The electrical wiring system of the invention is readily connected to an existing power source and the components are easy to snap together and assemble without hardwiring. Installation can be carried out quickly and safely with minimum exposure to sources of electrical voltage and current. The assembled circuit is weather resistant. Other electrical circuits also fall within the invention and other elements not specifically shown or described may take various forms known to persons of ordinary skill in the art.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. An electrical wiring connector comprising:

a generally rectangular flat base lying in a first plane;

a generally rectangular cover matable with the base, the cover having a top and side walls extending from a surface of the top to the base, the base and cover when in mating relation defining an enclosed space;

four openings in the cover, one opening in each of at least two of the side walls adjacent to the base;

hot, neutral and ground flat conductive strips carried by the base, each conductive strip being branched extending along a separate path between each of the four openings, each separate path traversing multiple planes; and a plurality of first terminals on respective ends of each conductive strip, each first terminal lying in a second plane parallel to the first plane.

2. The connector of claim 1, in which each of the plurality of first terminals is a spring clip.

3. The connector according to claim 1, further comprising first and second conducting blades and a conducting post protruding from below the base and connected to the hot, neutral and ground conductive strips, respectively, within the enclosed space.

4. The connector of claim 1, in which each strip is attached to the base by a fastener.

5. The connector of claim 1, in which each conductive strip is selected from a group consisting of copper, aluminum, copper clad aluminum and copper alloy.

6. The connector according to claim 1, in which each conductive strip comprises a second terminal projecting from an intermediate portion of the conductive strip within the enclosed space.

7. The connector according to claim 6, further comprising an electrical receptacle having a plurality of third terminals for connecting separately with each second terminal.

8. The connector of claim 1, in which the plurality of first terminals consists of four first terminals, one first terminal on each branch, so that one first terminal of each of the three conductive strips is located adjacent to one first terminal of each of the other two conductive strips.

9. The connector of claim 8, in which each first terminal is a spring clip.

10. An electrical wiring connector comprising:

a generally rectangular flat base lying in a first plane;

a generally rectangular cover matable with the base, the cover having a top and side walls extending from a surface of the top to the base, the base and cover when in mating relation defining an enclosed space;

at least two openings in the cover, one opening in each of at least two of the side walls adjacent to the base;

a plurality of separate, flat conductive strips carried by the base, each conductive strip having at least two ends, each conductive strip extending along a separate path between each of the at least two openings, each separate path traversing multiple planes;

a plurality of first terminals on respective ends of each conductive strip, each first terminal lying in a second plane parallel to the first plane;

a second terminal projecting from an intermediate portion of each conductive strip; and an electrical receptacle in the enclosed space having a plurality of third terminals for connecting separately with each second terminal, the electrical receptacle having a surface with a plurality of through openings for receiving the blades of an electrical plug, the receptacle surface surrounded by an aperture in the top of the connector.

11. The electrical wiring connector of claim 10, further comprising:

an aperture in an intermediate portion of each conductive strip; and a plurality of conducting posts protruding from below the base for connecting with an external source of electrical power, each one of the plurality of posts connected separately to the corresponding aperture of each conductive strip.

12. The connector of claim 10, in which each of the plurality of first terminals is a spring clip.

13. An electrical wiring connector comprising:

a generally rectangular flat base lying in a first plane;

a generally rectangular cover matable with the base, the cover having a top and side walls extending from a surface of the top to the base, the base and cover when in mating relation defining an enclosed space;

at least two openings in the cover, one opening in each of at least two of the side walls adjacent to the base;

a plurality of separate, flat conductive strips carried by the base, each conductive strip having at least two ends, each conductive strip extending along a separate path between each of the at least two openings, each separate path traversing multiple planes;

a plurality of first terminals on respective ends of each conductive strip, each first terminal lying in a second plane parallel to the first plane;

an aperture in an intermediate portion of each conductive strip; and a plurality of conducting posts protruding from below the base for connecting with an external source of electrical power, each one of the plurality of posts connected separately to the corresponding aperture of each conductive strip.

14. The connector of claim 13, in which each of the plurality of first terminals is a spring clip.

* * * * *